United States Patent [19]

Shimo et al.

[11] 3,975,905

[45] Aug. 24, 1976

[54] SECONDARY AIR FLOW RATE CONTROL DEVICE FOR USE IN EXHAUST GAS PURIFYING DEVICE

[75] Inventors: Shoji Shimo; Takeshi Atago, both of Katsuta, Japan

[73] Assignee: Hitachi, Ltd., Japan

[22] Filed: Nov. 11, 1974

[21] Appl. No.: 522,923

[30] Foreign Application Priority Data

Nov. 14, 1973 Japan ..... 48-127317

[52] U.S. Cl. ..... 60/290

[51] Int. Cl.[2] ..... F02B 75/10

[58] Field of Search ..... 60/290

[56] References Cited

UNITED STATES PATENTS

| | | | |
|---|---|---|---|
| 3,805,522 | 4/1974 | Sheppard | 60/290 |
| 3,818,702 | 6/1974 | Woo | 60/290 |
| 3,849,984 | 11/1974 | Toda | 60/290 |

*Primary Examiner*—Douglas Hart

*Attorney, Agent, or Firm*—Craig and Antonelli

[57] ABSTRACT

A secondary air flow rate control device for use in an exhaust gas purifying device of the type in which the secondary air delivered from an air pump is fed through an air passage to an exhaust gas purifying device provided in an exhaust system for purifying the unburnt components contained in exhaust gases from an internal combustion engine, while an aperture for bleeding air to atmosphere is provided in the aforesaid air passage, with a valve being provided in the aforesaid aperture, so that at the time of acceleration of an engine, the aforesaid valve is closed to increase the amount of the secondary air to be fed to the exhaust gas purifying device. This secondary air flow rate control device includes an air flow rate control mechanism for driving the valve which is provided in the aforesaid aperture for bleeding air to atmosphere, and an acceleration detecting mechanism for detecting the accelerating condition of an engine according to the pressure in a suction pipe, the aforesaid acceleration detecting mechanism being integral with the aforesaid air flow rate control mechanism, whereby by directly driving the aforesaid air flow rate control mechanism by using a pressure detected by means of the aforesaid acceleration detecting mechanism, the aforesaid aperture open to atmosphere is closed at the time of acceleration of an engine to thereby increase the amount of the secondary air to be fed to the exhaust gas purifying device, thus improving the responsive characteristics of the air flow rate control mechanism, with the additional advantages of achievement of compactness and simplicity for the construction of the air flow rate control device.

5 Claims, 6 Drawing Figures

SECONDARY AIR FLOW RATE CONTROL DEVICE FOR USE IN EXHAUST GAS PURIFYING DEVICE

BACKGROUND OF THE INVENTION

This invention relates to an exhaust gas purifying device for purifying hydrocarbons (HC) and carbon monoxide (CO) contained in exhaust gases from an internal combustion engine in the course of exhaust through an exhaust system, and more particularly to a secondary air flow rate control device for feeding the purifying air (which will be referred to as "the secondary air", hereinafter) to the exhaust gas purifying device of the engine. Hitherto, various kinds of purifying devices such as a catalyst convertor or an afterburner device have been incorporated in the exhaust system of an internal combustion engine for reducing the amounts of HC and CO contained in exhaust gases from an engine of a motor vehicle. Those devices dictate the use of the secondary air for purifying or oxidizing hydrocarbons or carbon monoxide contained in exhaust gases. In this respect, the secondary air is supplied from an air pump driven by means of an internal combustion engine or a motor.

However, those devices suffer from disadvantages in that, because the capacity of the aforesaid air pump is set so as to feed the maximum amount of the secondary air particularly when such is required during the running of an internal combustion engine, the amount of the secondary air being fed to the engine in the other running conditions, i.e., in the low running or decelerating condition becomes excessive in amounts, so that the cooling effect of the secondary air predominates over its reacting effect for the exhaust gas purifying device. To overcome this shortcoming, there has been proposed an attempt, in which a valve is provided in an air passage leading the secondary air from an air pump to the exhaust gas purifying device, and thus the aforesaid valve is drivine due to the suction negative pressure in carburetor or the like which supplies a mixture charge to the internal combustion engine, for the purpose of varying the cross sectional area of the aforesaid air passage, thus controlling the amount of the secondary air to be fed thereto. However, such an attempt to limit or throttle the cross sectional area of the air passage is tantamount to an attempt to limit the area of a delivery port of the air pump, so that it is not recommendable from the viewpoint of the durability of an air pump. Recently, there has been proposed another attempt, in which part of an air passage is open to atmosphere by providing an aperture and a valve is provided in the aforesaid aperture, whereby the secondary air to be supplied to the engine at the time of low load or decelerating condition thereof is bled into the atmosphere, thereby reducing the amount of the secondary air being fed to the exhaust gas purifying device in an attempt to promote or accelerate the reaction taking place in the exhaust gas purifying device. For better understanding of the background of the present invention, it may be advantageous to give more detailed description of this conventional device. The valve provided in the aforesaid aperture open to atmosphere is secured to a servo-diaphragm adapted to be driven due to the negative pressure in a suction pipe, and then the servo-diaphragm is in communication with the downstream of a carburetor via a negative pressure passage. In addition, an electromagnetic valve is built in this negative pressure passage, being connected to a micro-switch in an acceleration sensor. Since at the time of deceleration or low loading condition of an engine, the micro-switch remains inoperable and the electromagnetic valve keeps the negative pressure passage open, the negative pressure is applied to the servo-diaphragm and the valve is open so as to bleed the air fed from the air pump into atmosphere. With such an arrangement. when the engine is accelerated, the micro-switch is so actuated as to energize the electromagnetic valve to block the negative pressure which is being applied to the servo-diaphragm, while the valve closes the aperture open to atmosphere, thereby feeding a great amount of the secondary air to the exhaust gas purifying device. Thus, the actuation of the accelerating pump permits the purification or oxidation of HC and Co of an increased amount.

However, with the secondary air flow rate control device for use in an exhaust gas purifying device of such an arrangement, there have been encountered disadvantages in that, since the negative pressure is applied to the diaphragm of the acceleration sensor and in addition the air flow rate control portion is driven by feeding an electric current to the electromagnetic valve by way of the micro-switch or since the length of the negative pressure passage becomes excessive due to the layout of an engine room, there results delayed responsive characteristic of the air flow rate control portion to the variation in the negative pressure. This entails limitations on the purifying characteristics of the exhaust gas purifying device. On the other hand, in the light of the facts that various parts for use in the exhaust gas purifying device as well as safety means are to be built in an engine room in the near future, it is not reccommendable from the viewpoints of the layout of an engine room to individually prepare the parts for the acceleration sensor, electromagnetic valve, air flow rate control portion and the like for mounting same within the engine room. This further poses another disadvantage such as difficulties in handling and maintenance, and increased cost of manufacture. In addition, because of the use of the micro-switch, there necessarily be incurred frequent troubles in the micro-switches due to vibration in motor vehicle, thus causing the failure to operate the air flow rate control portion in the normal condition.

SUMMARY OF THE INVENTION

Objects of the invention

It is an object of the present invention to provide a secondary air flow rate control device which may be rapidly responsive to the running or operating condition of an engine, i.e., to the variation in negative pressure to thereby feed the secondary air to the exhaust gas purifying device in an optimum amount.

It is another object of the present invention to provide a secondary air flow rate control device which is compact in size, easy in handling and well suited for maintenance control.

Features of the invention

According to the present invention, there is provided a secondary air flow rate control device for use in an exhaust gas purifying device, which control device comprises: an air flow rate control mechanism adapted to drive the valve that is provided in an aperture, said aperture being provided in an air passage communicating an air pump with said exhaust gas purifying device; and an acceleration detecting mechanism for detecting the accelerating condition of an engine according to the pressure in a suction pipe, said detecting mechanism being integral with said control mechanism; whereby by driving said air flow rate control mechanism by using a pressure detected by means of said acceleration mechanism, said aperture for bleeding air to atmosphere is closed at the time of acceleration of the engine so as to increase the amount of the secondary air to be fed to said exhaust gas purifying device, thereby presenting improved responsive charactgeristic and compact but simple construction for said air flow rate control mechanism.

According to another aspect of the present invention, the opening and closing duration of a valve secured to a diaphragm in a flow rate control portion may be controlled by means of a minute hole provided in the diaphragm of the acceleration detecting mechanism.

According to a still further aspect of the present invention, a valve adapted to open or close a surge tank to or from atmosphere consists of an area control valve and a switching valve, whereby at the time of acceleration, air being bled from the surge tank is stopped by means of the switching valve, while at the time of the ordinary running condition, the amount of the secondary air being bled to atmosphere is metered by means of the area control valve and, on the other hand, at the time of deceleration, the area control valve and the switching valve are opened to a full extent to thereby bleed the secondary air to atmosphere.

DESCRIPTION OF THE PREFERRED EMBODIMENTS

Figure 1:
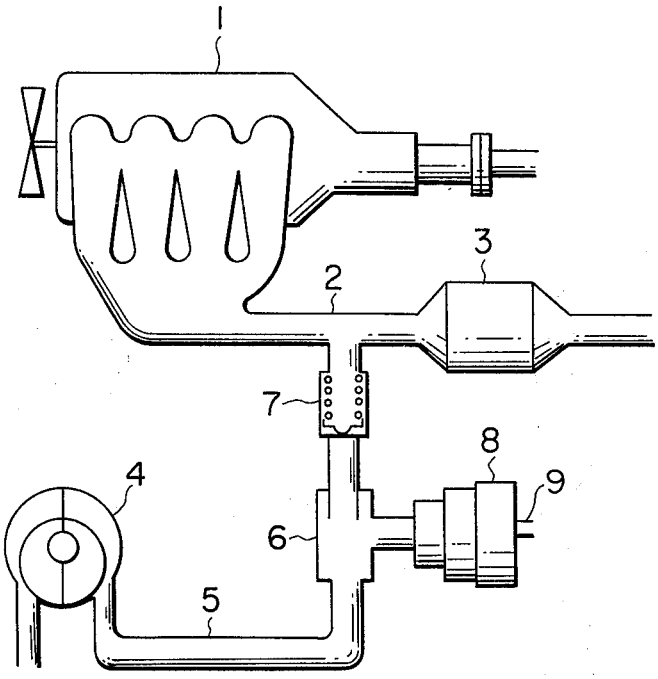
FIG. 1 is view showing the arrangement of the exhaust gas purifying device, in which the secondary air flow rate control device is incorporated, according to the present invention.
Figure 2:
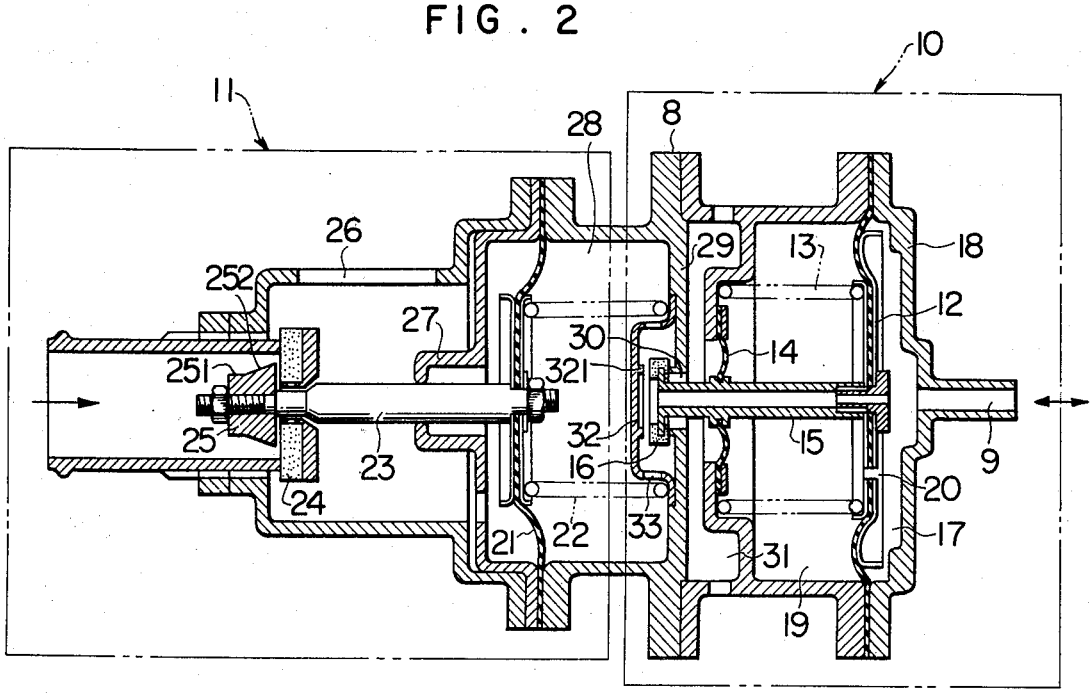
FIG. 2 is a longitudinal cross sectional view of the secondary air flow rate control device shown as one embodiment of the present invention.

Now, description will be given of one embodiment of the present invention with reference to FIGS. 1 and 2. FIG. 1 shows an exhaust gas purifying device as used with the embodiment of the present invention. Shown at 1 is an engine and at 2 an exhaust pipe. Built in the exhaust pipe 2 is an exhaust gas purifying device, i.e., a catalyst convertor 3 in this instance. Shown at 4 is an air pump which is driven through the medium of pulleys and pulley belts by means of the engine 1 for a pumping action. The air delivered from the air pump 4 is supplied via an air passage 5, surge tank 6, and check valve 7 to the upstream side of the catalyst convertor 3.

Shown at 8 is a secondary air control portion according to the present invention, and the secondary air control portion 8 is communicated by way of a negative pressure passage 9 with the downstream side of a carburetor. Referring to FIG. 2 which shows the secondary air flow rate control device of the invention, shown at 10 is an acceleration detecting portion which constitutes a secondary air flow rate control device in combination with the flow rate control portion 11. The acceleration detecting portion 10 consists of a first diaphragm 12, diaphragm spring 13, subsidiary diaphragm 14, hollow rod 15 and switching valve 16 secured to the hollow rod 15 is secured to the first diaphragm 12. Shown at 17 is a first negative pressure chamber which is defined between the first diaphragm 12 and a housing 18 and communicated by way of the negative pressure passage 9 with the downstream side of a carburetor. Designated 19 is a second negative pressure chamber which is defined between the first diaphragm 12 and a subsidiary diaphragm 14 and communicated through a minute hole 20 provided in the first diaphragm 12 with the first negative pressure chamber 17. The flow rate control portion 11 consists of a second diaphragm 21, diaphragm spring 22, rod 23, switching valve 24, and area control valve 25. The rod 23 is secured to the second diaphragm 21, with the tip thereof mounting the switching valve 24 and the area control valve 25 thereon rigidly. Shown at 26 is an aperture for bleeding air to atmosphere, and the aperture 26 is communicated by way of the switching valve 24 and area control valve 25 with the surge tank 6. Represented by 27 is a supporter which prevents vibration in the rod 23. Shown at 28 is a third negative pressure chamber which is defined by the second diaphragm 21 and a partition wall 29. Provided in the partition wall 29 is an aperture 30 which is open to atmosphere. The aperture 30 is opened or closed by a switching valve 16 provided at the tip of the hollow rod 15 in the acceleration detecting portion 10. The aperture 30 open to atmosphere is open to an atmospheric chamber 31. In addition, the partition wall 29 is formed with a seat piece 32 of a flat U shape, and thus the switching valve 16 is seated on the seat piece 32, when the switching valve 16 maintains the aperture 30 open. In addition, there are provided several minute holes 33 in the seat piece 32.

In the normal operation or running, the negative pressure prevailing downstream of a carburetor is introduced through the suction pipe 9 into a first negative pressure chamber 17. However, the aforesaid negative pressure is not to such a level which can compress the diaphragm spring 13, so that the switching valve 16 secured to the hollow rod 15 is biased to the right as viewed in FIG. 2 by means of the diaphragm spring 13 to thereby block the aperture 30 from atmosphere. When the aperture 30 is closed, then the negative pressure in the negative pressure passage 9 is introduced through the hollow rod 15, then through the minute hole 33 in the seat piece 32 into the third negative pressure chamber 28. When the negative pressure is introduced into the third negative pressure chamber 28, then the second diaphragm 21 is displaced to the right as viewed in FIG. 2, thereby opening the switching valve 24 by the medium of the rod 23, so that the rear control valve 25 meters the amount of the secondary air being fed into atmosphere through the air bleeding aperture 26, thus controlling the amount of the secondary air to be fed into a catalyst convertor.

Since the negative pressure valve 16 in the decelerating condition closes the aperture 30, the negative pressure downstream of the carburetor is introduced through the hollow rod 15, minute holes 33 in the seat piece 32 into the third negative pressure chamber 28. However, at the time of deceleration, since the negative pressure downstream of a throttle valve is considerably high, so that the third diaphragm 21 is displaced to the right to a great extent, whereby the switching valve 24 and area control valve 25 secured to the rod 23 are opened to their full extent to increase the amount of the secondary air being fed to atmosphere, while reducing the amount of the secondary air being fed to the catalyst convertor, with the result of the increase in temperature of catalysts.

Subsequently, upon acceleration, the negative pressure to be introduced through the negative pressure passage 9 into the first negative pressure chamber 17 is decreased in its level, so that the first diaphragm 12 is displaced to the left as viewed in FIG. 2 against the action of the diaphragm spring 13. When the first diaphragm 12 is displaced, then the switching valve 16 secured to the hollow rod 15 opens the aperture 30 and abuts the seat portion 321 of the seat piece 32, thereby interrupting the introduction of the negative pressure through negative pressure passage 9 into the third negative pressure chamber 28. In this condition, since the atmosphere is introduced from the atmospheric chamber 31 through aperture 30 and minute holes 33 into the third negative pressure chamber 28, the second diaphragm 21 is displaced to the left as viewed in FIG. 2 by means of the diaphragm spring 22, so the switching valve 24 secured to the rod 23 blocks the communication between the air bleeding aperture 26 and the surge tank 6, thereby keeping the secondary air from atmosphere. In this manner, the secondary air of an amount corresponding to the increase in the amount of CO and HC is fed in excess to the catalyst convertor due to compensation for acceleration, so that the secondary air of an amount optimum to catalysts may be fed to the catalyst convertor. In this respect, the minute hole 20 provided in the first diaphragm 12 serves to determine the duration, in which the negative pressure valve 16 maintains the aperture 30 open at the time of the acceleration. Thus, the timing to open the aperture 30 may be determined by selecting the hole 20 for its desired size.

Figure 3:
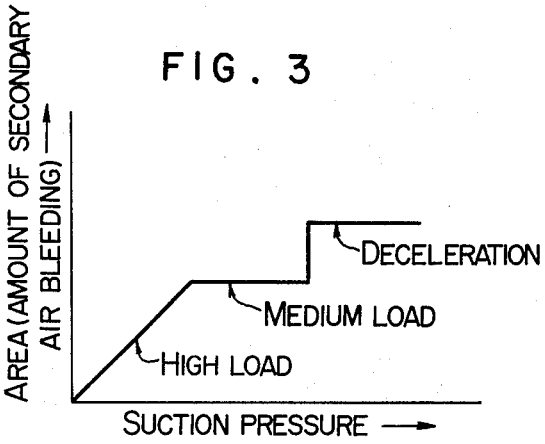
FIG. 3 is a graph illustrating the characteristics of the engine suction pressure and the amount of secondary air being bled in the secondary air flow rate control device embodying the present invention.
Figure 4:
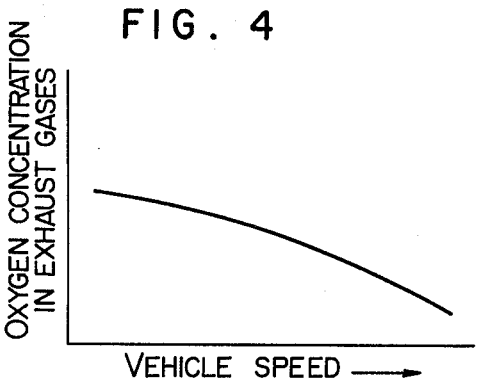
FIG. 4 is a graph illustrating the characteristics of the oxygen concentration in the exhaust gases and vehicle speed.

Turning now to the description of the operations of the switching valve 24 and area control valve 25 mounted on the tip portion of the rod 23 secured to the second diaphragm 21 and constituting the flow rate control device 11, in conjunction with FIGS. 3 and 4. In general, the relationship between the vehicle speed and the oxygen concentration of exhaust gases in an internal combustion engine is such that the oxygen concentration decreases with an increase in the vehicle speed, as shown in FIG. 4. For this reason, according to the secondary air flow rate control device of the present invention, the amount of the secondary air being supplied is increased with the decrease in the negative pressure in suction pipe in an attempt to achieve a constant oxygen concentration despite the vibration in vehicle speed. In other words, at the time of deceleration, the switching valve 24 and area control valve 25 are in their fully open positions as shown in FIG. 3, thereby discharging the secondary air to atmosphere. At this time, since the oxygen concentration is relatively high, the secondary air of a small amount may be fed to the catalyst convertor. The oxygen concentration during the medium load running, as well, maintains a relatively consistent condition, and the amount of the secondary air being fed to atmosphere may be metered by means of a parallel portion 251 of the area control valve 25. It is not to mention that this parallel portion 251 may be arbitrarily selected. At the time of a further higher load running, since the oxygen concentration is reduced, the amount of the secondary air being discharged to atmosphere is reduced by means of a tapered portion 252 gradually, and then the amount of the secondary air is reduced to zero by means of the switching valve 24, eventually. Accordingly, the variation in oxygen concentration due to variation in the vehicle speed may be prevented by means of the switching valve 24 and area control valve 25. Although the tapered portion 252 may be arbitrarily selected, it is possible that there are provided a stepped portion for the parallel portion 251, commensurate with the requirement for an engine, to thereby discharge the secondary air progressively.

Figure 5:
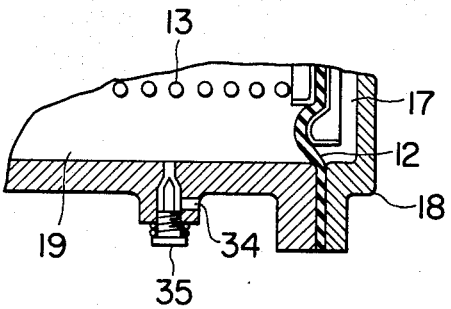
FIG. 5 is a partly enlarged view of the secondary air flow rate control device improved according to the present invention.

Meanwhile, with the secondary air control device of a mechanism according to the present invention, there may be encountered a yield problem. This is particularly true with the acceleration detecting portion 10. As a solution to this problem, as shown in FIG. 5, there is provided a leak hole 34 which communicates the second negative pressure chamber 19 with atmosphere, with an adjusting screw 35 is provided for the leak hole 34 for controlling area of the hole 34.

Figure 6:
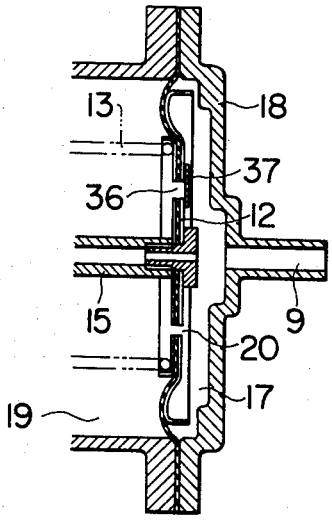
FIG. 6 is a partly enlarged cross sectional view of the secondary air flow rate control device improved according to the present invention.

In other words, if there is difficulty in manufacture in maintaining constant the duration of time, in which the negative pressure valve 16 keeps the aperture 30 open to atmosphere at the time of acceleration, an attempt may be adopted, in which the adjusting screw 35 is rotated for adjusting the level of the negative pressure leaking through the leak hole 34, thereby arbitrarily selecting the duration of time, in which the negative pressure valve 16 maintains the aperture 30 open to atmosphere. In addition, in case a special mode of acceleration is carried out, i.e., in case a vehicle is once accelerated, then decelerated to a slight degree, and then accelerated again, there may be encountered a problem that, at the time of the first acceleration, the pressure in the second negative pressure chamber 19 becomes close to the positive pressure, and thus the pressure is not immediately returned to the suction pressure after the completion of the acceleration, taking a considerable time therefor when resorting to the minute hole 20, with the result of the delayed response before restoring to the initial condition. To cope with this sort of a problem, as shown in FIG. 6, the pressure within the second negative pressure chamber 19 is immediately returned to the suction negative pressure after acceleration for providing for detection of the subsequent acceleration, to thereby improve the response in returning to the initial condition. In other words, as shown in FIG. 6, there is provided a communicating hole 36 in part of the first diaphragm 12, with one-way valve 37 being provided in the communicating hole 36. Thus, when the pressure in the first negative pressure chamber 17 is higher than the negative pressure as at the time of the acceleration, the one way valve 37 is opened. With such an arrangement, the communicating hole 36 is maintained closed at the time of acceleration, and then due to the subsequent deceleration, the one way valve 37 is opened, so that the pressure in the second negative pressure chamber 19 is turned to the negative pressure for suction. In addition, when accelerated from such as condition, then the pressure in the second negative pressure chamber is restored to the negative pressure for suction, so that the accelerating condition may be detected to thereby improve the response in returning to the initial condition.

As is apparent from the foregoing description of the secondary air flow rate control device of the present invention, the amount of the secondary air to be fed to the exhaust gas purifying device is controlled to an optimum level, commensurate with the running conditions of the vehicle. In addition, the acceleration detecting portion and the flow rate control portion are provided integrally with each other in the secondary air flow rate control device, so that there may be provided a secondary air flow rate control device which is compact in size, easy in handling and maintenance control.

What is claimed is:

1. A secondary air flow rate control arrangement for use in an exhaust gas purifying device which includes an air pump for delivering secondary air through an air passage to an exhaust gas purifying device in an exhaust system for purifying unburnt components contained in exhaust gases from an internal combustion engine, an air bleeding aperture for bleeding air to the atmosphere, and a valve means provided in said aperture for controlling the amount of secondary air fed to the exhaust gas purifying device, the secondary air flow rate control arrangement comprising:

an air flow rate control means for controlling the position of said valve means;

an acceleration detecting means for detecting the acceleration condition of the internal combustion engine and providing an output pressure signal in accordance with a pressure prevailing in a suction pipe of the internal combustion engine, said acceleration detecting means and said air flow rate control means forming an integral unit and being operatively connected whereby said air flow rate control means closes said valve means and said air bleeding aperture at the time of acceleration of the engine in response to an output pressure signal of said acceleration detecting means;

said valve means being adapted to close the air bleeding aperture by introducing an atmospheric pressure into said air flow rate control means when said acceleration detecting means provides an output signal indicative of an accelerating condition of the internal combustion engine, said valve means bleeds the air delivered from the air pump through said air bleeding aperture by introducing a negative pressure into said air flow rate control means except at the time of acceleration of the internal combustion engine;

a first chamber and a second chamber defined by a partition wall in a cylindrical hollow body;

a first diaphragm provided within said first chamber, one side of said first diaphragm being in communication with a downstream side of a carburetor of the internal combustion engine;

a hollow rod secured to said first diaphragm on the other side thereof;

said valve means including a negative pressure valve provided at the tip of said hollow rod, said negative pressure valve being adapted to open and close said air bleeding aperture to the atmosphere;

said air bleeding aperture being provided in said partition wall and communicating said second chamber with the atmosphere;

said negative pressure valve being adapted to introduce atmospheric pressure into said second chamber when a negative pressure downstream of a throttle valve of the carburetor of the internal combustion engine is relatively low and to introduce a negative pressure through said hollow rod when the negative pressure downstream of the throttle valve is relatively high, a second diaphragm provided in said second chamber, oen side of said second diaphragm being adapted to receive the negative pressure introduced through said hollow rod as well as the atmospheric pressure when said negative pressure is interrupted;

a rod secured to said second diaphragm on the other side thereof; and a further valve means for bleeding or interrupting air delivered from said air pump to the atmosphere.

2. A secondary air flow rate control arrangement as set forth in claim 1, further comprising:

a subsidiary diaphragm secured to a shank portion of said hollow rod, said subsidiary diaphragm and said first diaphragm defining therebetween a further chamber, and a minute hole provided in said first diaphragm to control the period of time during which said negative pressure valve is opened or closed.

3. A secondary air flow rate control arrangement as set forth in claim 1, further comprising:

an area control valve means;

said further valve means includes a switching valve, said switching valve and said area control valve means being provided on the tip portion of said rod secured to said second diaphragm whereby at a time of a low load running of the internal combustion engine said area control valve controls the amount of air being bled to the atmosphere, at a time of a deceleration of the internal combustion engine said area control valve and said switching valve are opened to their full extent, and at a time of a high load running of the internal combustion engine said switching valve interrupts the bleeding of air to the atmosphere.

4. A secondary air flow rate control arrangement as set forth in claim 1, further comprising:

a leak hole communicating with the atmosphere provided in said first chamber; and an adjusting screw for adjusting said leak hole whereby the area of said leak hole is controlled by means of said adjusting screw.

5. A secondary air flow rate control arrangement as set forth in claim 1, further comprising:

a communicating hole provided in said first diaphragm so as to communicate one side thereof with the other side thereof; and a one-way valve in said communicating hole whereby said one-way valve may close said communicating hole at the time of acceleration of the internal combustion engine.

* * * * *